US005393539A

United States Patent [19]

Reskow

[11] Patent Number: 5,393,539

[45] Date of Patent: Feb. 28, 1995

[54] MOLDED PLASTIC OVERWRAP TRAY

[75] Inventor: Daniel W. Reskow, Long Valley, N.J.

[73] Assignee: Tekni-Plex Inc., Brooklyn, N.Y.

[21] Appl. No.: 166,706

[22] Filed: Dec. 13, 1993

[51] Int. Cl.[6] ..... B65D 85/00

[52] U.S. Cl. ..... 426/124; 426/106; 426/129; 206/557; 206/565; 206/814; 229/407; 220/651; 220/659; 220/653

[58] Field of Search ..... 426/106, 124, 129, 128, 426/396; 206/557, 560, 565, 814, 821; 53/410; 229/2.5 R; 220/651, 653, 655, 659

[56] References Cited

U.S. PATENT DOCUMENTS

| | | | |
|---|---|---|---|
| 2,106,426 | 1/1938 | Grant | 53/410 X |
| 2,918,379 | 12/1959 | Lurie | 206/557 X |
| 3,480,197 | 11/1969 | Massey | 426/106 X |
| 3,563,445 | 2/1971 | Clayton | 426/129 |
| 3,986,655 | 10/1976 | Rynning | 229/2.5 R |
| 4,548,852 | 10/1985 | Mitchell | 53/432 X |
| 4,590,078 | 5/1986 | Umina | 426/128 X |
| 4,877,609 | 10/1989 | Beck et al. | 426/128 X |
| 5,018,623 | 5/1991 | Henyo | 206/557 |

*Primary Examiner*—Donald E. Czaja
*Assistant Examiner*—Milton I. Cano
*Attorney, Agent, or Firm*—McAulay Fisher Nissen Goldberg & Kiel

[57] ABSTRACT

A molded plastic overwrap tray is disclosed having a base and first and second sets of opposed sidewalls. The base and sidewalls define a food retaining chamber. The upper edges of the sidewalls define an upper plane of the tray. The upper edges of one set of opposed sidewalls have first and second pairs of opposed indentations for receiving the respective opposed ends of a pair of spaced-apart support bars. The support bars have an upper surface defining a plane substantially parallel to the upper plane of the tray, whereby an overwrap on the tray is supported by the upper surface of the support bars to minimize sagging of the overwrap and prevent the overwrap from coming in contact with food in the food retaining chamber. The support bars also assist in maintaining the engaged opposed upper edges substantially parallel to one another to reduce distortion and breakage of the tray when the overwrap is tightly stretched thereover.

8 Claims, 2 Drawing Sheets

MOLDED PLASTIC OVERWRAP TRAY

BACKGROUND OF THE INVENTION

1. Field of the Invention

This invention relates generally to a molded plastic overwrap tray, and in particular, to an overwrap tray for use in the packaging of sausage products.

II. Description of the Prior Art

Molded plastic overwrap trays are commonly used in the meat processing industry. These trays are constructed from polystyrene foam and serve as a tray for the packaging for meat products. The trays, having meat placed thereon, are then sealed with an overwrap of transparent film.

The trays are generally rectangular in shape and made in a variety of sizes using thermo-forming machinery. The machinery and methods for manufacturing these trays are well known in the art. Recent advances in the gas flush method of packaging meat products, when used with the known meat packaging trays, results in prolonged shelf-life of the products wrapped therein.

Using the known trays in combination with the gas flush packaging method, however, results in discoloration of the product packaged. Products which are packaged using the gas flush method and which are touched by the overwrap film, or which shift during movement or storage and contact other product and/or wrapping, exhibit discolorization at the point of contact. The discolorization has proven to be visually objectionable, thereby negatively effecting the sale of products wrapped using the conventional trays.

In addition, there is a tendency for packaging machinery to wrap the overwrap so tightly over the current trays so as to cause distortion. More specifically, the tightly wrapped film tends to bow the sidewalls of the trays inwardly. This may result in cracking or breaking of the trays, particularly if the polystyrene foam is brittle. Furthermore, stacks of product packaged according to the current packaging method are often unsteady, since the upper packages rest on the compressible and non-uniform product in the package below.

The present invention improves on the trays known in the art by a tray construction which minimizes tray breakage, improves stackability, and minimizes the visually displeasing marks which often result from contact of meat products with the overwrap film in the manner hereinafter described.

SUMMARY OF THE INVENTION

The invention provides for a plastic tray having a base and sidewalls. The base and sidewalls define a food retaining chamber. Adjacent sidewalls are connected to one another through an integrally formed radial corner. Each of the sidewalls has an upper edge, the upper edges of the sidewalls defining a first plane of the tray. The upper edges of the sidewalls support a bar over the food retaining chamber of the tray. In this fashion, therefore, the plastic overwrap is supported above the food placed in the food retaining chamber. Accordingly, the objectionable discoloring which results from contact between the plastic overwrap and the packaged food product is minimized. In addition, the bar may be positioned so as to hold the product within the food retaining chamber, thereby, preventing movement of the product once the overwrap film is positioned.

Additional features and advantages of the present invention will become more apparent from a consideration of the following detailed description when taken in conjunction with the accompanying drawings.

DESCRIPTION OF THE PREFERRED EMBODIMENT

Figure 1:
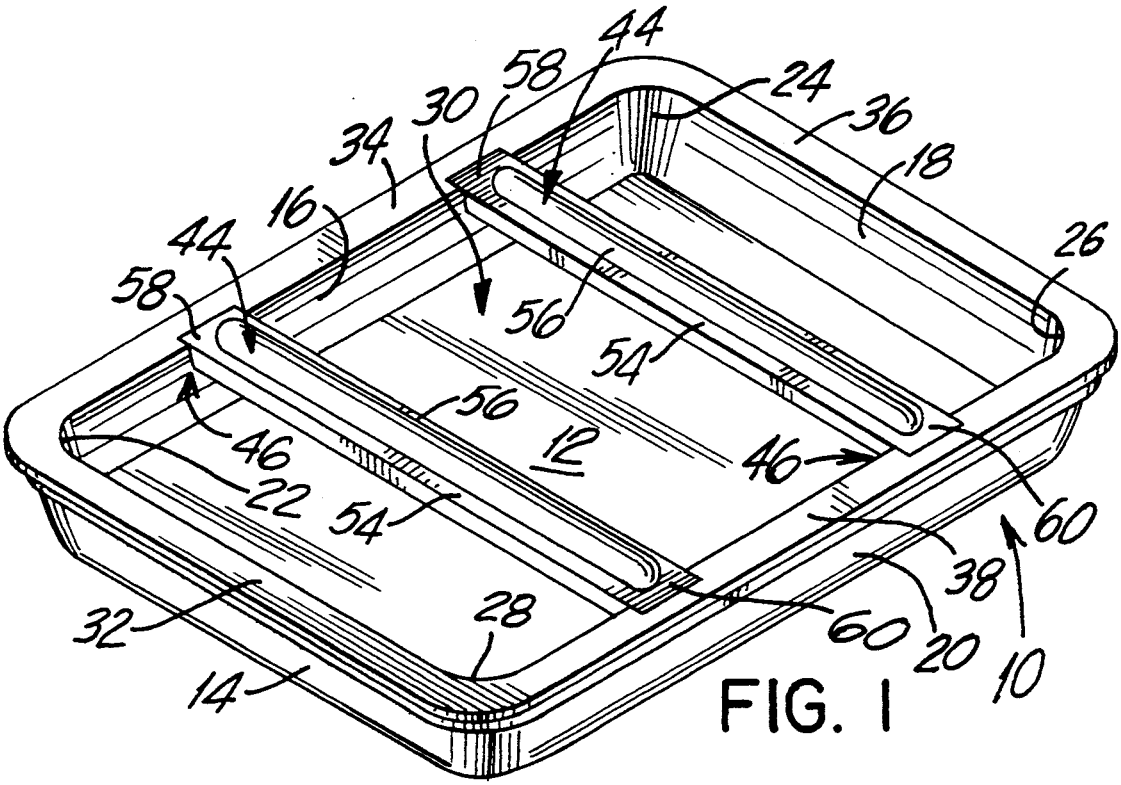
FIG. 1 is a perspective view of the plastic tray constructed in accordance with the present invention.
Figure 2:
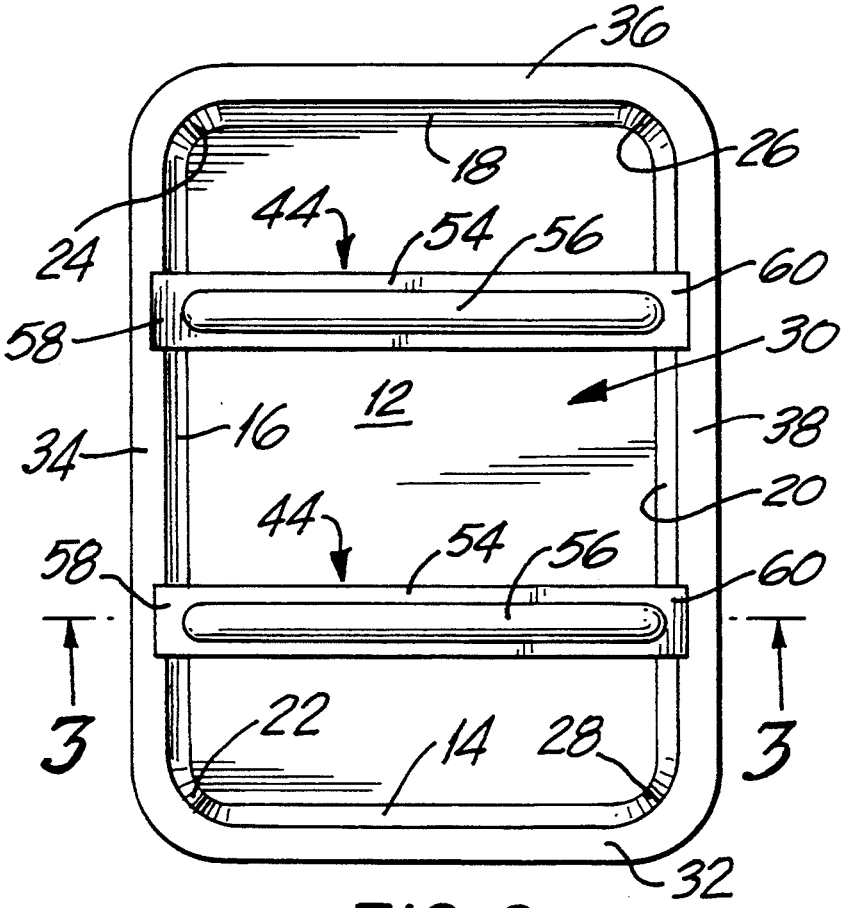
FIG. 2 is a top plain view thereof.

Referring to FIGS. 1 through 7, numeral 10 represents a plastic tray constructed in accordance with the present invention. Tray 10 includes a base 12 and four sidewalls 14, 16, 18 and 20. Sidewalls 14 and 18 are positioned opposite to one another. Similarly, sidewalls 16 and 20 are positioned opposite to one another.

Adjacent sidewalls 14 and 16, 16 and 18, 18 and 20, and 20 and 14 are joined by radial corners 22, 24, 26 and 28, respectively. Sidewalls 14–20 and base 12 define food retaining chamber 30. Sidewalls 14–20 include upper edges 32, 34, 36 and 38, respectively, which define an upper plane of tray 10.

The sidewalls 14–20 bow outwardly at an angle of approximately 30° from a vertical axis. Sidewalls 14–20 are formed having a reinforcing bead 40 located on the outer surface of said sidewalls adjacent to the open end of tray 10. Bead 40 serves to resist deflection of said sidewalls during overwrapping with a tightly stretched transparent film 42.

Tray 10 also includes a pair of overwrap film support bars 44, each similarly constructed, supported by support means 46. Support means 46 preferably takes the form of opposed indentations 48 and 50 in the opposing upper edges 34 and 38 of sidewalls 16 and 20. Alternatively, the support means 46 may take the form of slots in said upper edges, slots or through openings in said sidewalls, or support columns positioned on base 12. In its most simplest form, support bars 44 may rest on opposing upper edges 34 and 38 of opposing sidewalls 16 and 20, respectively.

Support means 46 must support bars 44 over food retaining chamber 30. Support means 46 may also position bars 44 with respect to each other and the remaining opposed sidewalls 14 and 18.

Referring to FIGS. 3–6, support bar 44 includes a first side 52 and a second side 54. A longitudinally extending rib 56 projects outwardly form side 54 and extends for substantially the entire length of bar 44 terminating, at opposite ends, just short of the opposite ends of the bar 44 to define shoulder end portions 58 and 60 of bar 44.

Support bars 44 support the overwrap film 42 stretched over food retaining chamber 30 to prevent contact between food 62 positioned in food retaining chamber 30 and the overwrap film 42. Furthermore, support bars 44 may prevent movement of the food product or sausage 62 placed in food retaining chamber 30.

In the embodiment illustrated, the shoulder end portions 58 and 60 of bar 44 engage with the indentations 48 and 50, respectively, in the opposing upper edges 34 and 38 of sidewalls 16 and 20. The engagement is such that support bars 44 maintain opposing upper edges 34 and 38 substantially parallel to one another to prevent distortion and breakage of tray 10 when overwrap film 42 is tightly stretched thereover.

Figure 3:
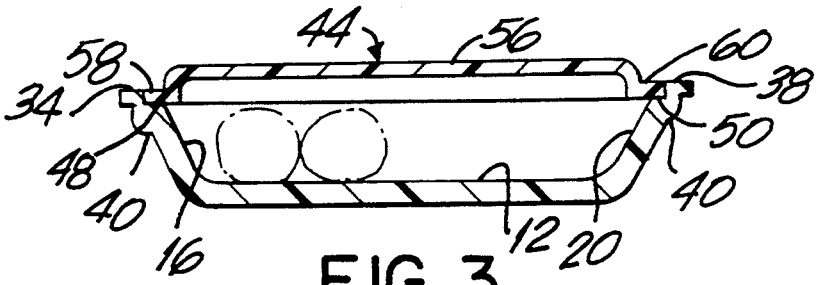
FIG. 3 is a sectional view taken along line 3—3 of FIG. 2.

In FIG. 3, the first side 52 of bar 44 is positioned nearer to base 12 than second side 54. As such, rib 56 may be regarded as lying in a plane which extends above the upper plane of tray 10 and is parallel thereto.

Figure 4:
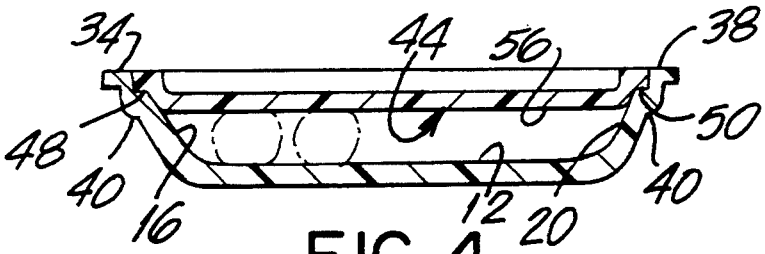
FIG. 4 is a view similar to FIG. 3 with the bar in an inverted position so as to minimize movement of the product contained within the tray.
Figure 5:
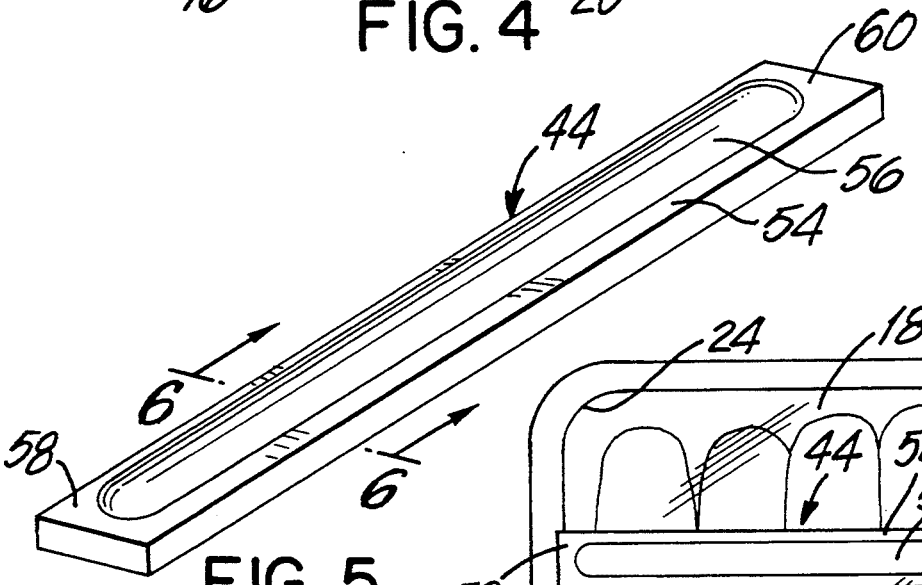
FIG. 5 is a perspective view of the bar used in accordance with the present invention.
Figure 6:
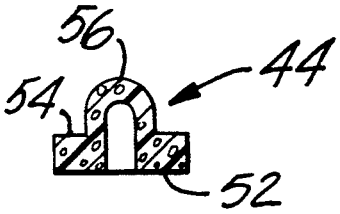
FIG. 6 is sectional view taken along line 6—6 of FIG. 5.
Figure 7:
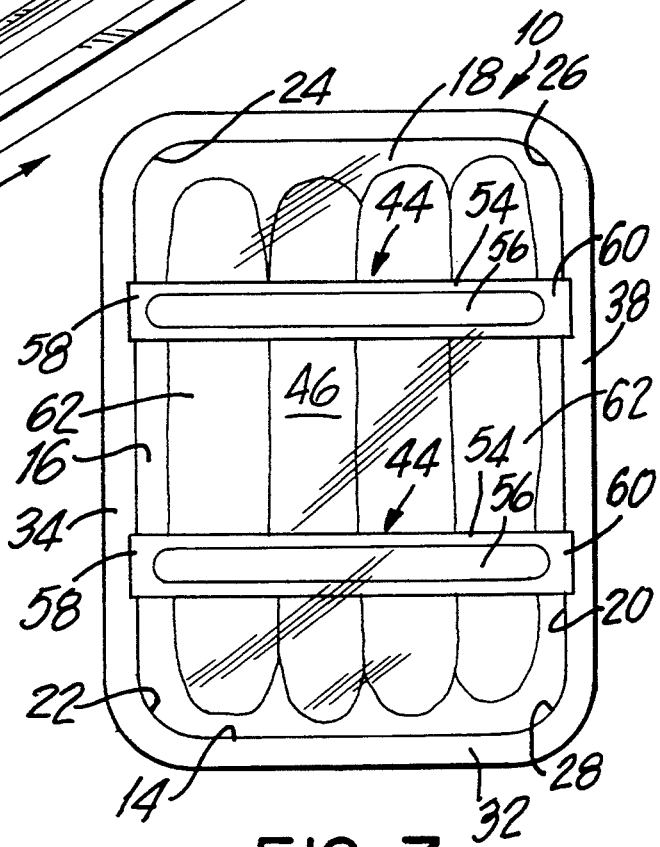
FIG. 7 is a view similar to FIG. 2 with the tray containing sausage links and being sealed with an overwrap of transparent film.

In FIG. 4, the orientation of bar 44 is reversed so that the second side 54 is positioned nearer to base 12. As such, rib 56 extends below the upper plane of tray 10 but is still substantially parallel thereto. In this configuration, bars 44 are seen as engaging the sausage food product 62 which may be of value in preventing movement thereof. Regardless of the orientation of bars 44, they provide a uniform outer surface, thereby improving stackability of a number of trays.

In an alternative embodiment, through-openings are formed in the upper edges 34 and 38 of sidewalls 16 and 20. The shoulder end portions 58 and 60 of bars 44 would be received or pass through such openings. However, the opposed end portions of rib 56 would engage and bear against the inner surfaces of said sidewalls to minimize inward deflection of said sidewalls when overwrap film is stretched thereover.

Tray 10 is preferably molded from expanded polystyrene foam utilizing thermo-forming machinery and techniques well known in the art. The material should be sufficiently stiff or rigid to support meat products placed therein, and the stacking of such trays one on top of another, while, at the same time remaining resilient and flexible to prevent breakage and facilitate sealing of the overwrap film used thereon.

The thickness of base 12 and sidewalls 14–20 may be approximately 0.210 inches (0.533 cm). The connection between base 12 and sidewalls 14–20 is made through a radius of approximately 0.625 inches (1.588 cm). Tray 10 may have a height of approximately 1.250 inches (3.175 cm).

Tray 10 may be constructed in a variety of sizes. In the embodiment illustrated, tray 10 has a width of approximately 6.531 inches (16.589 cm) and a length of approximately 8.625 inches (21.908 cm). Typically, radial corners 22–28 have a radius in the range from approximately 0.29 inches (0.737 cm) to approximately 0.50 inches (1.27 cm).

Support means 46 may take the form of opposing slots 48 and 50, each having a width of approximately 0.750 inches (1.905 cm) and a depth of approximately 0.187 inches (0.475 cm). Pairs of opposing slots 48 and 50 are located approximately 1.625 inches (4.128 cm) from the center of tray 10. The width of each slot may decrease over the depth. Each wall of the slot forms an angle of approximately 20° with a vertical axis to decrease the width of the slot over the depth of the slot.

Support bars 44 may be approximately 0.750 inches (1.905 cm) wide and approximately 5.750 inches (14.605 cm) in length. The width of longitudinal rib 56 may be approximately 0.375 inches (0.953 cm). Shoulders 58 and 60 measure approximately 0.250 inches (0.635 cm) along the length of support bars 44. The support bars 44 are approximately 0.187 inches (0.475 cm) thick at shoulders 58 and 60 and approximately 0.50 inches (1.27 cm) thick along longitudinal rib 56.

While a preferred embodiment of the invention has been shown and described in detail, it will be readily understood and appreciated that numerous omissions, changes, and additions may be made without departing from the spirit and scope of the invention. For example, in its simplest form, the present invention includes a base, a sidewall and a support bar, the sidewall supporting the support bar over a food retaining chamber defined by the base and the sidewall.

What is claimed:

1. A molded plastic overwrap tray comprising:

a base and first and second sets of opposed sidewalls, each of said sidewalls having an upper edge, the upper edges of said sidewalls defining a first plane of said tray;

said base and sidewalls defining a food retaining chamber;

the upper edges of said first set of opposed sidewalls having first and second opposed indentations;

a support bar having first and second ends;

the first and second ends of said support bar sitting respectively in said first and second indentations to resist inward deflection of the upper edges of said sidewalls; and said support bar having an upper surface defining a second plane substantially parallel to said first plane of said tray;

whereby an overwrap on said tray is supported by the upper surface of said support bar to minimize sagging of the overwrap and prevent the overwrap from coming in contact with food in said food retaining chamber.

2. The plastic overwrap tray of claim 1 further comprising:

third and fourth opposed indentations in said first set of opposed sidewalls; and a second support bar having first and second ends received in said third and fourth opposed indentations, said second support bar having an upper surface defining a plane substantially the same as the plane defined by the upper surface of said first support bar.

3. The plastic overwrap tray of claim 1 wherein:

said support bar has opposed upper and lower surfaces and a longitudinal rib extending outwardly from one of said support bar surfaces; and said support bar, when positioned in said indentations with said rib extending upwardly, providing an upper surface above the plane of the upper edges of said sidewalls;

whereby any overwrap on said tray will be held at least partly above said plane of said tray by said rib.

4. The plastic overwrap tray of claim 2 wherein:

each of said support bars has opposed upper and lower surfaces and a longitudinal rib extending outwardly from one of said support bar surfaces; and said support bars, when positioned in said associated indentations with said ribs extending upwardly, providing respective upper surfaces above the plane of the upper edges of said sidewalls;

whereby any overwrap on said tray will be held at least partly above said first plane of said tray by said ribs.

5. The plastic overwrap tray of claim 1 wherein:

said sidewalls have an outer surface inclined outwardly from said base to the upper edges of said sidewalls; and said sidewalls further having an integrally formed reinforcing bead located on the outer surface thereof adjacent to the open end of said tray, said bead serving to resist deflection of said sidewalls upon application of the overwrap to said tray.

6. The plastic overwrap tray of claim 1 wherein:

said first plane is located a first distance from said base; and said second plane is located at a second distance from said base, said second distance being substantially equal to said first distance.

7. A molded plastic overwrap tray comprising:

a base;

a sidewall connected to said base, said sidewall and base defining a food retaining chamber; and a support bar, said support bar being supported by said sidewall and suspended over said food retaining chamber;

whereby an overwrap over said food retaining chamber is supported by said support bar to minimize sagging of the overwrap and prevent contact between the overwrap and food in said food retaining chamber.

8. The plastic overwrap tray of claim 7 wherein said support bar engages said sidewall to minimize distortion of said tray due to overwrapping.

* * * * *